US006899572B1

(12) United States Patent
Baker et al.

(10) Patent No.: US 6,899,572 B1
(45) Date of Patent: May 31, 2005

(54) ELECTRICAL SOCKET CONTACT WITH TINES

(75) Inventors: Craig H. Baker, Shrewsbury, MA (US); Clyde T. Carter, Shermans Dale, PA (US); Alexander S. Fater, Worcester, MA (US); Urs F. Nager, Hudson, NH (US); Christopher P. Palagi, Upton, MA (US); Christine Mary Svelnis, Boylston, MA (US); Mark A. Wojcicki, Holden, MA (US)

(73) Assignee: Anderson Power Products, Sterling, MA (US)

( * ) Notice: Subject to any disclaimer, the term of this patent is extended or adjusted under 35 U.S.C. 154(b) by 0 days.

(21) Appl. No.: 09/375,114

(22) Filed: Aug. 16, 1999

(51) Int. Cl.[7] ..... H01R 11/22
(52) U.S. Cl. ..... 439/851; 439/748; 439/181
(58) Field of Search ..... 439/181, 851, 439/853, 843, 743, 748

(56) References Cited

U.S. PATENT DOCUMENTS

| | | | | | |
|---|---|---|---|---|---|
| 3,862,792 | A | * | 1/1975 | Jayne | 439/851 |
| 3,924,922 | A | * | 12/1975 | DeCenzo | 439/851 |
| 4,606,599 | A | * | 8/1986 | Grant et al. | 439/743 |
| 4,707,050 | A | * | 11/1987 | Konnemann | 439/851 |
| 5,108,304 | A | * | 4/1992 | Bogiel et al. | 439/851 |
| 5,529,517 | A | * | 6/1996 | Hopf et al. | 439/851 |
| 6,250,974 | B1 | * | 6/2001 | Kerek | 439/843 |

* cited by examiner

*Primary Examiner*—Tho D. Ta
(74) *Attorney, Agent, or Firm*—Nixon Peabody LLP

(57) ABSTRACT

An electrical socket contact with a plurality of tines for mating with a pin contact. At least one tine functions as an initial arc receiving tine while another tine functions as an axially extending pin contacting tine. The pin contacting tine has a shorter axial length than the arc receiving tine so that the arc receiving tine produces a make-first/break-last electrical contact.

8 Claims, 5 Drawing Sheets

ELECTRICAL SOCKET CONTACT WITH TINES

BACKGROUND OF THE INVENTION

The present invention relates to electrical contacts in general, and more particularly to an electrical female socket contact that mates with a male pin contact to provide a sacrificial make-first/break-last contact arrangement for use in a "hot pluggable" electrical contact configuration.

There is a need for electrical contacts that can be connected and disconnected under an electrical load i.e., "hot pluggable" and at the same time have the capability of accommodating axial misalignment of pin and socket electrical contacts. Furthermore, the socket contact should be able to provide an arc receiving "sacrificial" portion to maintain electrical integrity of the fully mated pin and socket contacts.

It is accordingly a general object of the invention to fulfill this need.

BRIEF DESCRIPTION OF THE INVENTION

An electrical socket contact for mating with a pin contact utilizes at least one an axially extending arc receiving tine and at least one axially extending pin contact engaging tine. The arc receiving tine is positioned at a maximum distance from the socket axis that is greater than the maximum transverse dimension of the pin contact while the pin contact engaging tine is position at a distance less than the pin's maximum transverse dimension. In addition, the arc receiving tine is longer than the pin contact engaging tine so that the arc receiving tine provides a make-first/break-last electrical connection.

DETAILED DESCRIPTION

Figure 1A:
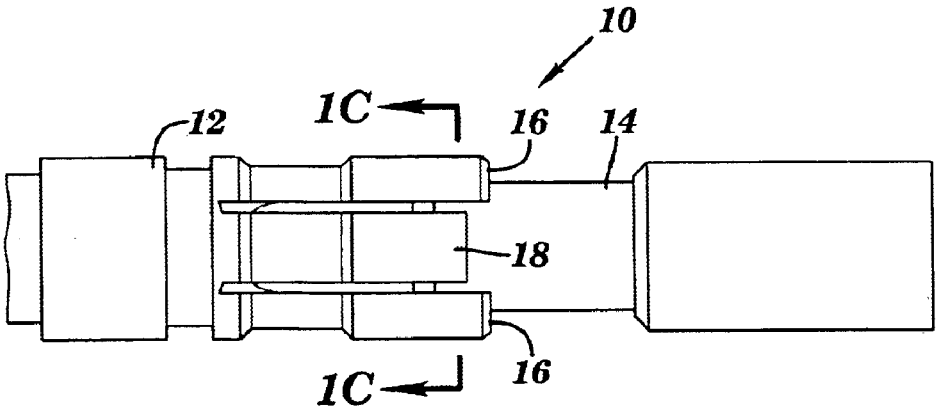
FIG. 1A is a view in side elevation of the socket contact of the present invention with a pin contact partially mated therein.
Figure 1B:
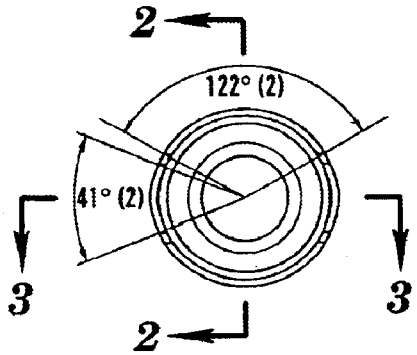
FIG. 1B is an end view of the socket contact of FIG. 1A illustrating the angular relationships of the socket tines.
Figure 1C:
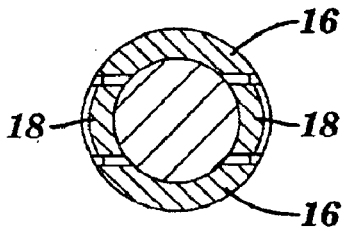
FIG. 1C is view in cross-section taken along line 1C—1C in FIG. 1A.

Turning now to the drawings, and particularly to FIG. 1A, there is shown an electrical connector indicated generally by the reference numeral 10. The connector 10 comprises a female socket contact 12 of the present invention and a male pin contact 14 that is depicted partially mated with the socket contact 12.

The socket contact 12 preferably has a plurality of relatively stiff tines 16 and a plurality of relatively flexible tines 18. Note that the axial length of tines 16 is longer than the axial length of the pin contacting tines 18. The tines 16 function as arc receiving tine which engage and disengage the male pin contact 14 in a make-first/break-last relationship. The arc receiving tines 16 are positioned with respect to the bore axis of the socket contact at a maximum distance that is greater than the maximum transverse distance (the diameter in the case of a circular male pin contact) of the pin contact. This dimensional arrangement permits misalignment of the axis of the male pin with the bore axis of the female socket contact, a situation that occurs in practical terms in a "hot pluggable" connector.

Figure 2:
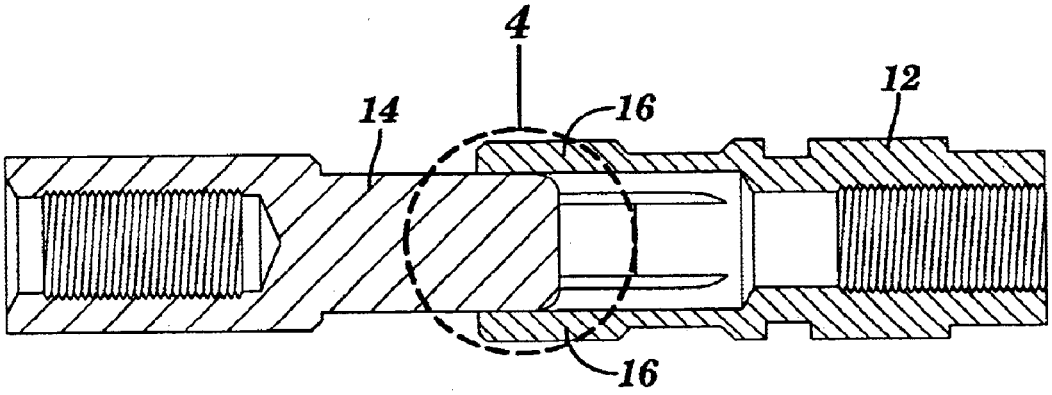
FIG. 2 is a view in cross-section taken along line 2—2 in FIG. 1B.
Figure 3:
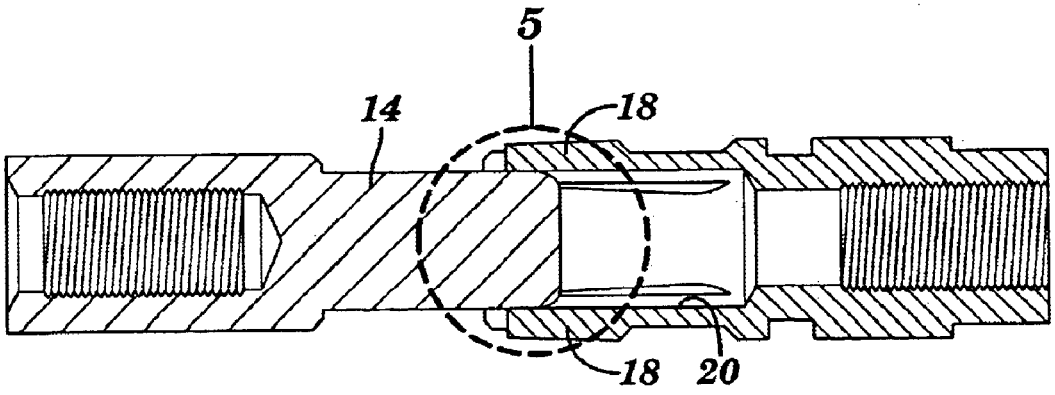
FIG. 3 is a view in cross-section taken along line 3—3 in FIG. 1B.
Figure 4:
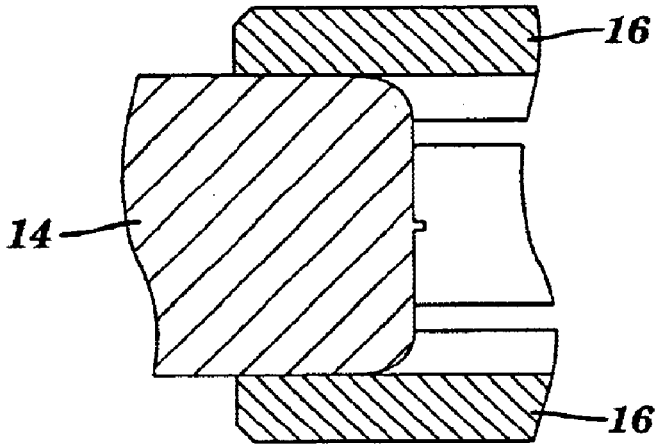
FIG. 4 is an enlarged view in cross-section showing the relatively loose fit of the pin contact with the arc receiving tines of the socket contact.
Figure 5:
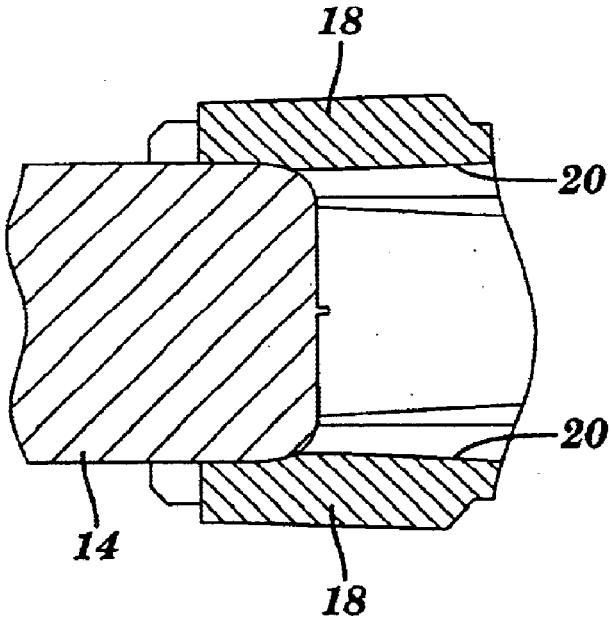
FIG. 5 is another enlarged view in cross-section, but showing the friction fit of the pin contact engaging tines of the socket contact.

FIGS. 2 and 4 depict the relatively "loose" dimensional relationship of the male pin contact and the arc receiving tines 16. However, the pin contact engaging tines 18 have a different dimensional relationship with respect to the male pin. These tines 18 are position at a maximum distance from the socket contact bore axis that is less than the maximum transverse dimension of the pin contact to provide an electrically conductive, friction fit of the axially extending pin contacting surface 20 (FIGS. 3 and 5).

Figure 6A:
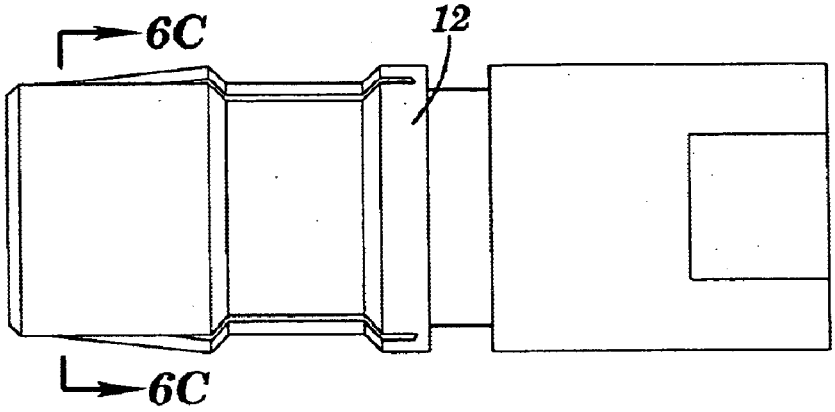
FIG. 6A is a side elevation view of a socket contact.
Figure 6B:
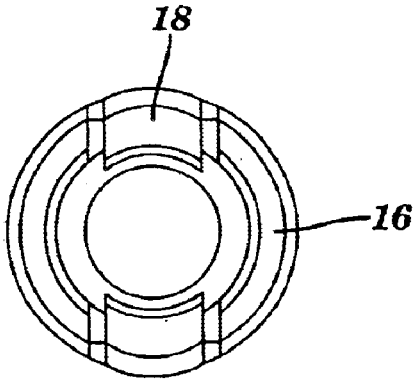
FIG. 6B is an end view of the socket contact of FIG. 6A with the inward compression of the pin contact engaging tines exaggerated for purposes of illustration.
Figure 6C:
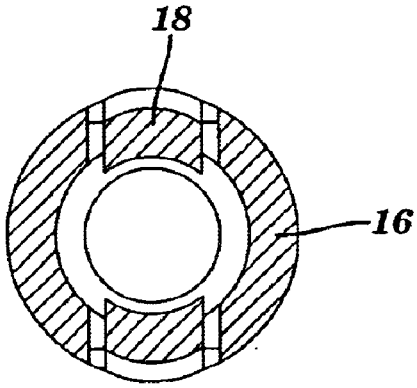
FIG. 6C is a sectional view taken along line 6C—6C with similar positional exaggeration to that shown in FIG. 6B.
Figure 7A:
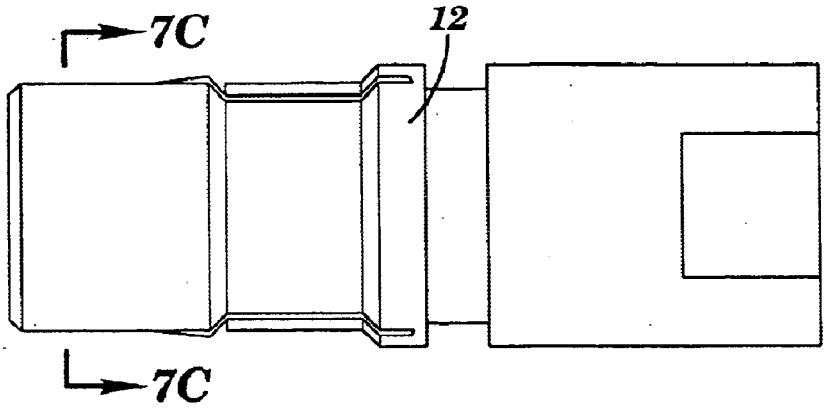
FIG. 7A is a side elevation view of another socket contact.
Figure 7B:
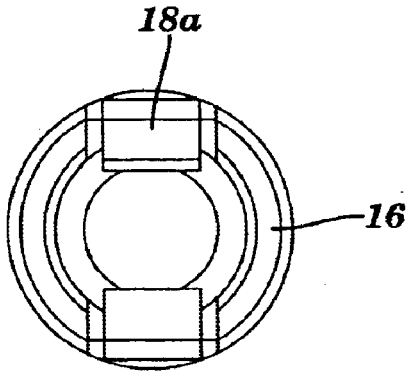
FIG. 7B is an end view of the socket contact of FIG. 7A with the inward compression of the pin contact engaging tines exaggerated for purposes of illustration.
Figure 7C:
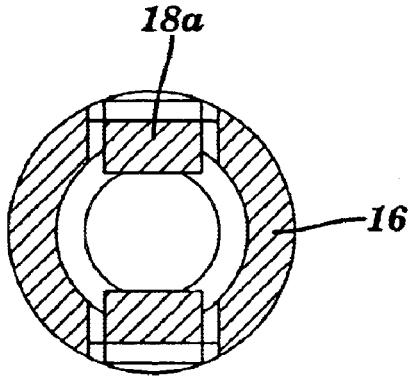
FIG. 7C is a sectional view taken along line 7C—7C with similar positional exaggeration to that shown in FIG. 7B.

Looking at FIGS. 6A, 6B, and 6C, these Figures illustrate the tines 16 and 18 with each tine having the same radius, but with the tines 18 having been compressed inwardly towards the bore axis as shown in exaggerated form in FIGS. 6B and 6C. A similar arrangement is depicted in the FIGS. 7A, 7B, and 7C series, but with a non-circular male pin contact and non-circular tines 18*a*.

Having described in detail a preferred embodiment of our invention, it will be apparent to those in the art that numerous modifications can be made therein without departing from the scope of the invention as defined in the following claims.

What we claim is:

1. An electrical socket contact for mating with a pin contact comprising:

an electrically conductive body having a pin contact engaging axial bore defined by:

at least one relatively fixed pin contact arc receiving tine; and, at least one relatively movable pin contact engaging tine, said pin contact arc receiving tine having an axially extending pin contact engaging surface positioned at a maximum distance from the bore axis that is greater than the maximum transverse dimension of the pin contact from the bore axis and said pin contact engaging tine having an axially extending pin contacting surface positioned at a maximum distance from the bore axis that is less than the maximum transverse dimension of the pin contact from the bore axis and having an axial length that is less than the axial length of the pin contact arc receiving tine.

2. The electrical socket contact of claim 1 further comprising two opposed, pin contact arc receiving tines and two opposed pin contact engaging tines.

3. The electrical socket contact of claim 1 wherein said pin contact has a circular transverse cross-section.

4. The electrical socket contact of claim 1 wherein said pin contact has a non-circular transverse cross-section.

5. The electrical socket contact of claim 4 wherein said pin contact has a square transverse cross-section.

6. An electrical socket contact for mating with a pin contact comprising:

an electrically conductive body having a pin contact engaging axial bore defined by:

at least one relatively fixed pin contact arc receiving tine; and, at least one relatively movable pin contact engaging tine, said pin contact arc receiving tine having an arcuate, axially extending pin contact engaging surface with a radius greater than the radius of the pin contact and said pin contact engaging tine having an arcuate, axially extending pin contacting surface positioned at a maximum distance from the bore axis that is less than the maximum transverse dimension of the pin contact from the bore axis and having an axial length less than the axial length of the pin contact arc receiving tine.

7. The electrical socket contact of claim 6 further comprising two radially opposed, pin contact arc receiving tines and two opposed pin contact engaging tines.

8. The electrical socket contact of claim 7 wherein the ratio of the cumulative arcuate length of the two radially opposed pin contact arc receiving tines and the cumulative arcuate length of the two radially opposed, pin contact engaging tines is approximately 2:1.

* * * * *